US007240730B2

(12) United States Patent
Williams et al.

(10) Patent No.: US 7,240,730 B2
(45) Date of Patent: Jul. 10, 2007

(54) USE OF FIBER OPTICS IN DEVIATED FLOWS

(75) Inventors: Glynn R Williams, Winchester (GB); Kevin J Forbes, Houston, TX (US); Arthur H Hartog, Southampton (GB); Christian Koeniger, Egelsbach (DE); George A Brown, Beaconsfield (GB)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 11/280,532

(22) Filed: Nov. 17, 2005

(65) Prior Publication Data

US 2006/0065393 A1 Mar. 30, 2006

(51) Int. Cl.
*G01F 1/68* (2006.01)

(52) U.S. Cl. ..... 166/250.03; 73/204.23; 73/152.18; 374/137

(58) Field of Classification Search ..... 166/250.02, 166/250.03, 66; 385/12; 73/204.11, 204.22, 73/152.18, 152.33, 204.23; 356/43; 250/269.1; 374/136, 137

See application file for complete search history.

(56) References Cited

U.S. PATENT DOCUMENTS

| | | | |
|---|---|---|---|
| 4,823,166 | A | 4/1989 | Hartog et al. |
| 5,247,990 | A | 9/1993 | Sudol et al. |
| 5,358,042 | A | 10/1994 | Stoltz |
| 5,509,474 | A | 4/1996 | Cooke, Jr. |
| 5,592,282 | A | 1/1997 | Hartog |
| 6,279,660 | B1 | 8/2001 | Hay et al. |
| 6,550,342 | B2 | 4/2003 | Croteau et al. |
| 6,601,458 | B1 | 8/2003 | Gysling et al. |
| 2003/0094281 | A1 | 5/2003 | Tubel |
| 2003/0126921 | A1 | 7/2003 | Zisk et al. |
| 2004/0000197 | A1* | 1/2004 | Gysling ..... 73/861.63 |
| 2004/0011950 | A1 | 1/2004 | Harkins |
| 2004/0059505 | A1* | 3/2004 | Gallagher ..... 702/1 |
| 2006/0115204 | A1* | 6/2006 | Marsh et al. ..... 385/12 |

FOREIGN PATENT DOCUMENTS

| | | |
|---|---|---|
| GB | 2284257 | 5/1995 |
| GB | 2311546 | 10/1997 |

(Continued)

*Primary Examiner*—David Bagnell
*Assistant Examiner*—Daniel P. Stephenson
(74) *Attorney, Agent, or Firm*—Winstead; Dona C. Edwards; Bryan P. Galloway

(57) ABSTRACT

A system to determine the mixture of fluids in the deviated section of a wellbore comprising at least one distributed temperature sensor adapted to measure the temperature profile along at least two levels of a vertical axis of the deviated section. Each distributed temperature sensor can be a fiber optic line functionally connected to a light source that may utilize optical time domain reflectometry to measure the temperature profile along the length of the fiber line. The temperature profiles at different positions along the vertical axis of the deviated wellbore enables the determination of the cross-sectional distribution of fluids flowing along the deviated section. Together with the fluid velocity of each of the fluids flowing along the deviated section, the cross-sectional fluid distribution enables the calculation of the flow rates of each of the fluids. The system may also be used in conjunction with a pipeline, such as a subsea pipeline, to determine the flow rates of fluids flowing therethrough.

13 Claims, 4 Drawing Sheets

FOREIGN PATENT DOCUMENTS

| | | |
|---|---|---|
| GB | 2347449 | 9/2000 |
| GB | 2354782 | 4/2001 |
| WO | WO 9850680 | 11/1998 |
| WO | WO 9850681 | 11/1998 |
| WO | WO 99/60360 | 11/1999 |
| WO | WO 99/64781 | 12/1999 |
| WO | WO 01/75403 | 10/2001 |

* cited by examiner

USE OF FIBER OPTICS IN DEVIATED FLOWS

BACKGROUND

The present invention generally relates to the use of fiber optics in wellbores. More particularly, this invention relates to the use of fiber optics in deviated wells, including horizontal wells. The present invention may also be used in conjunction with pipelines, such as but not limited to subsea pipelines.

Flow of fluids into and along a deviated well is highly dynamic and is difficult to analyze. Among other flow regimes, fluid flow along a deviated well can be stratified, wherein different fluids stratify based on their density and flow along the well within their stratum. Typically, fluids stratify so that hydrocarbon gas is located on top, hydrocarbon liquid underneath the hydrocarbon gas, and water, if any, below the hydrocarbon liquid. Another flow regime that may be present in a deviated well is "slug flow," wherein slugs of gas and liquid alternately flow along the well.

In any case, not only is the identity of the fluids (hydrocarbon gas, hydrocarbon liquid, water, or a mixture thereof) along the length and vertical axis of the deviated well difficult to determine, but the location of any hydrocarbon gas/hydrocarbon liquid/water interface(s) (if such is present) is also difficult to establish. This information would be useful to an operator in order to understand the content and fluid contributions of the relevant formation and wellbore. With such information, an operator could diagnose inflow characteristics and non-conformances, with a view to optimizing production conditions or planning interventions for remediations.

Similarly, many pipelines, such as subsea pipelines, also include stratified flow. In these pipelines, it would also be useful to identify the fluids flowing therethrough and the presence and location of any stratification.

Thus, there exists a continuing need for an arrangement and/or technique that addresses one or more of the problems that are stated above.

SUMMARY

A system to determine the mixture of fluids in the deviated section of a wellbore comprising at least one distributed temperature sensor adapted to measure the temperature profile along at least two levels of a vertical axis of the deviated section. Each distributed temperature sensor can be a fiber optic line functionally connected to a light source that may utilize optical time domain reflectometry to measure the temperature profile along the length of the fiber line. The temperature profiles at different positions along the vertical axis of the deviated wellbore enables the determination of the cross-sectional distribution of fluids flowing along the deviated section. Together with the fluid velocity of each of the fluids flowing along the deviated section, the cross-sectional fluid distribution enables the calculation of the flow rates of each of the fluids. The system may also be used in conjunction with a pipeline, such as a subsea pipeline, to determine the flow rates of fluids flowing therethrough.

DETAILED DESCRIPTION

Figure 1:
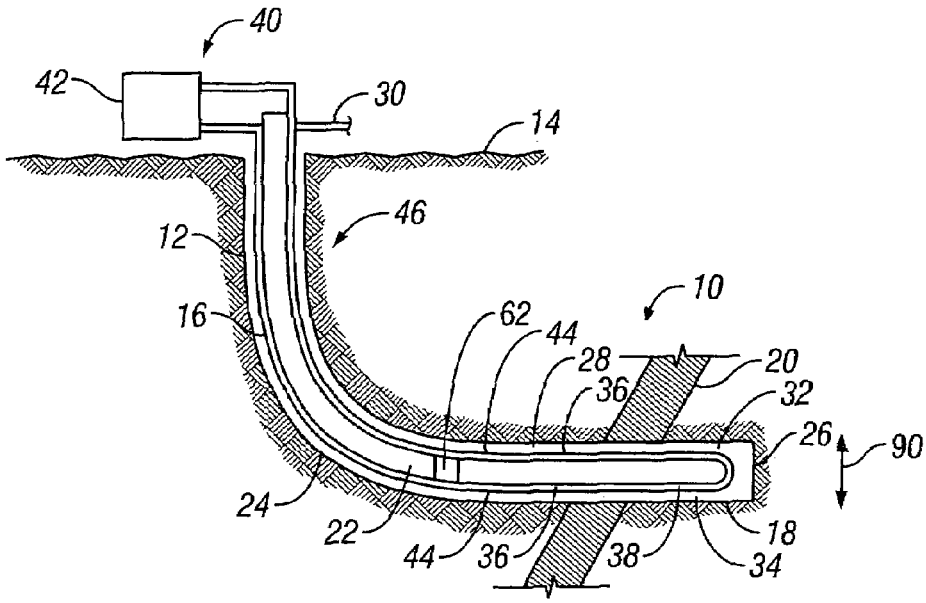
FIG. 1 is a schematic of one embodiment of the system that is the subject of the present invention disposed in a deviated wellbore.

FIG. 1 illustrates the system 10 of the present invention. A wellbore 12, which may be cased, extends from the surface 14 and may include a vertical section 16 and a deviated section 18. Deviated section 18 is angled from the vertical section 16 and can extend in the horizontal direction. "Deviated section" shall mean a wellbore section having any angular deviation from a completely vertical section. Wellbore 12 normally intersects at least one formation 20 containing hydrocarbon fluids.

Figure 6:
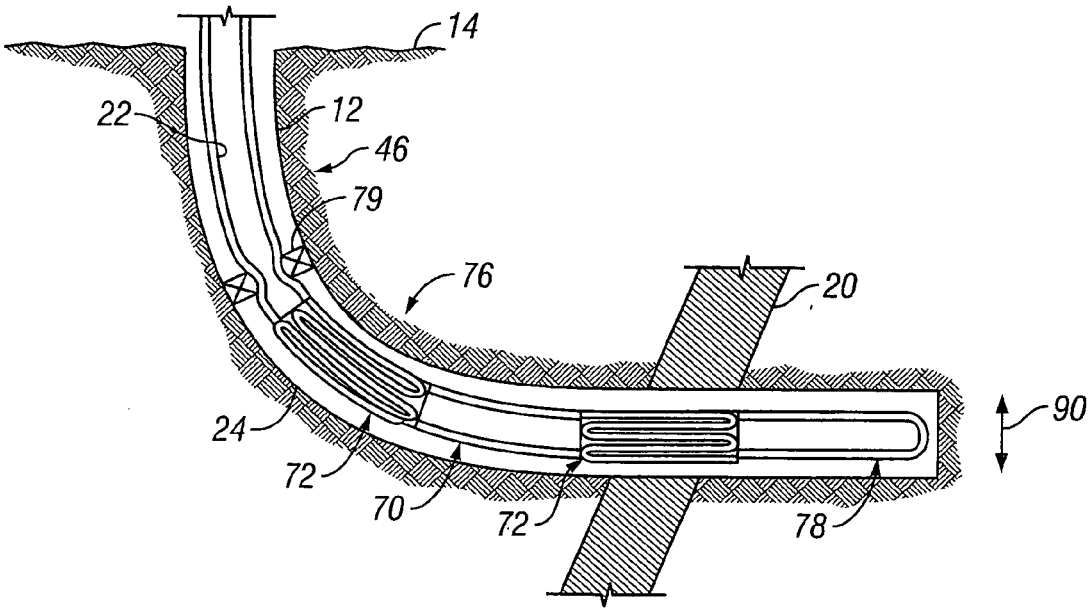
FIG. 6 is a schematic of another embodiment of the system, wherein the system includes at least one low resolution section and at least one high resolution section.

A tubing 22, which may be production tubing or coiled tubing among others, may be disposed within the wellbore 12. In one embodiment, the tubing 22 extends into the deviated section 18 past the heel 24 of the wellbore 12 and proximate the toe 26 of the wellbore 12. As shown in FIG. 6, tubing 22 may also include a stinger assembly 76 that extends past the bottom hole packer 79 into the deviated section 18.

Generally, fluids flow from the formation 20 into the annulus 28 of the wellbore 12, into the tubing 22 (or stinger assembly 76), and to the surface 14 of the wellbore 12 through the tubing 22. In some embodiments, an artificial lift device, such as a pump, may be used to aid fluid flow to the surface 14. The fluids are then transmitted via a pipeline 30 to a remote location. The fluids may be separated from each other (hydrocarbon gas/hydrocarbon liquid/water) within the wellbore or at the surface by use of separator devices, as known in the prior art.

As previously described, fluids flowing from the formation 20 may comprise hydrocarbon liquids, hydrocarbon gases, water, or a combination thereof. It is beneficial and useful to identify the fluids (whether they are hydrocarbon liquids, hydrocarbon gases, water, or a combination thereof) flowing from formation 20 and along the deviated section 18. In deviated sections 18 of wellbores 12, the mixture of fluids tends to be very dynamic and may stratify, wherein the fluids differ at least between the top area 32 and the bottom area 34 of the deviated section 18. For instance, in the case where no water is present, the mixture of fluids proximate the top area 32 tends to be mostly hydrocarbon gas, if not all hydrocarbon gas, and the mixture of fluids proximate the bottom area 34 tends to be hydrocarbon liquid, if not all hydrocarbon liquid. If water is present in the formation and is flowing into the deviated section 18, the water typically stratifies below the hydrocarbon liquid adding yet another layer. It is beneficial to know the type of mixture along the vertical axis 90 of the deviated section 18 and when and where the fluid strata form because, among other things, this information allows the calculation of the flow rate of each fluid along the pipe.

In order to determine the hydrocarbon gas, hydrocarbon liquid, and water flow rates in the deviated section 18 of a wellbore, one must first determine [a] the cross-sectional distribution of the different fluids and [b] the velocity of each of the fluids. When the flow regime is slug flow as previously described, instead of determining the velocity of each of the fluids, one can use the average of the fluid velocity in the core of the slug flow. This invention provides a technique to determine the cross-sectional distribution of the different fluid strata.

System 10 enables the determination of the cross-sectional distribution of the different fluids flowing along the vertical axis 90 of the deviated section 18, including at the bottom area 34 and the top area 32. In one embodiment, system 10 comprises at least one distributed temperature sensor 36 that measures the temperature profile along at least two levels of the vertical axis 90 of the deviated section 18. In one embodiment, two distributed temperature sensors 36 are deployed, one proximate the top area 32 of the deviated section 18 and another proximate the bottom area 34 of the deviated section 18. Each distributed temperature sensor 36 may comprise a fiber optic line 38 that is adapted to sense temperature along its length.

In one embodiment, fiber optic line 38 is part of an optical time domain reflectometry (OTDR) system 40 which also includes a surface system 42 with a light source and a computer or logic device. OTDR systems are known in the prior art, such as those described in U.S. Pat. Nos. 4,823,166 and 5,592,282 issued to Hartog, both of which are incorporated herein by reference. In OTDR, a pulse of optical energy is launched into an optical fiber and the backscattered optical energy returning from the fiber is observed as a function of time, which is proportional to distance along the fiber from which the backscattered light is received. This backscattered light includes the Rayleigh, Brillouin, and Raman spectrums. The Raman spectrum is the most temperature sensitive with the intensity of the spectrum varying with temperature, although Brillouin scattering and in certain cases Rayleigh scattering are temperature sensitive.

Generally, in one embodiment, pulses of light at a fixed wavelength are transmitted from the light source in surface equipment 42 down the fiber optic line 38. At every measurement point in the line 38, light is back-scattered and returns to the surface equipment 32. Knowing the speed of light and the moment of arrival of the return signal enables its point of origin along the fiber line 38 to be determined. Temperature stimulates the energy levels of molecules of the silica and of other index-modifying additives—such as germania—present in the fiber line 38. The back-scattered light contains upshifted and downshifted wavebands (such as the Stokes Raman and Anti-Stokes Raman portions of the back-scattered spectrum) which can be analyzed to determine the temperature at origin. In this way the temperature of each of the responding measurement points in the fiber line 38 can be calculated by the equipment 42, providing a complete temperature profile along the length of the fiber line 38.

Thus, the temperature profile along the length of each of the fiber optic lines 38 can be known. As will be discussed, by using different embodiments of system 10, the temperature profile along many levels of the vertical axis 90 of the deviated section 18 can also be known. Knowing the temperature profile along the vertical axis 90 of the deviated section 18, the cross-sectional distribution of the fluids flowing therethrough can be determined not only in the vertical direction from the top area to the bottom area but also along the length of the deviated section 18.

One can identify the fluids from the temperature profiles because the hydrocarbon gases and the hydrocarbon liquids normally have different temperatures within the same wellbore. Therefore, a difference in temperature along the vertical axis 90 typically signifies the presence of different fluids. For instance, gas is typically cooler than the hydrocarbon liquids (and any water), since it cools as it enters the wellbore (the Joule-Thompson effect). The presence of water may also be identified in some instances, when the water entering the wellbore is at a different temperature than the hydrocarbon liquids. Knowing these normal temperature differences between fluids and the typical stratification of fluids as previously disclosed (hydrocarbon gas/hydrocarbon liquid/water) allows the identification of fluids in any cross-section of the deviated section 18.

Figure 5:
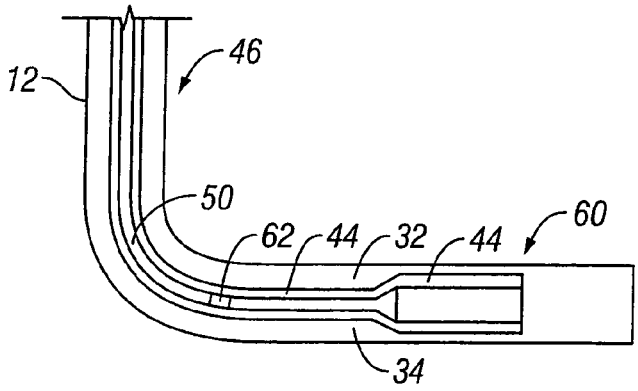
FIG. 5 is a schematic of the system deployed on a coiled tubing.

For deployment within wellbore 12, each fiber line 38 is disposed on a conveyance device 46, which can be permanently or temporarily deployed in wellbore 12. Conveyance device 46 may comprise, among others, production tubing 22, as shown in FIG. 1, coiled tubing 50, as shown in FIG. 5, or even a stinger assembly 76, as shown in FIG. 6.

In one embodiment, one fiber line 38 is located proximate the top area 32 and another fiber line 38 is located proximate the bottom area 34. In order to ensure that one fiber line 38 is at least located proximate the top area 32 and that one fiber line 38 is at least located proximate the bottom area 34, system 10 may in one embodiment include an orienting device 62 that may be attached to conveyance device 46. In one embodiment, orienting device 62 orients system 10 so that the fiber line 38 in the top area 32 is approximately at the topmost position and the fiber line 38 in the bottom area 34 is approximately at the bottommost position (in this embodiment, the fiber lines 38 are 180 degrees apart). Orienting device 62 may comprise, among others, a gyro tool or a mechanical orienting mechanism such as a muleshoe. In general, orienting device 62 may comprise a unilaterally/azimuthally weighted conveyance device 46 with at least one swivel that provides gravitational alignment and orientation.

Figure 2:
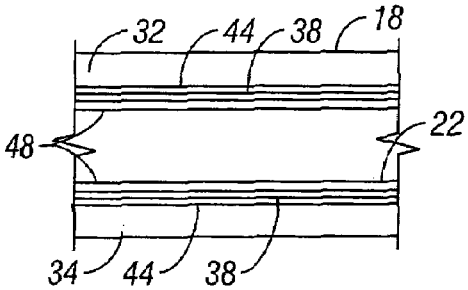
FIG. 2 is a schematic of one embodiment for the attachment of a conduit with fiber line therein to a conveyance device.

In one embodiment, each fiber line 38 is disposed in a conduit 44, such as a tube. Although the material, construction and size of conduit 44 may vary depending on the application, an exemplary conduit 44 is a stainless steel tube. The exemplary tube has a diameter less than approximately one half inch and often is approximately one-quarter inch. Conduit 44 may be attached to conveyance device 46. As shown in FIG. 2, each conduit 44 (for instance at top area 32 and bottom area 34) can be attached to conveyance device 46 (in this case production tubing 22) by way of clamps 48 or other mechanical attachments, as known in the prior art.

In one embodiment as shown in FIG. 1, one fiber line 38 is arranged to measure the temperature profile of both the top and bottom areas 32, 34. In this embodiment, the fiber line 38 has a U-shape as does the relevant conduit 44. Thus, this U-shaped fiber optic line 38 (and conduit 44) includes a leg that extends away from the surface 14 and a leg that extends towards the surface 14.

The fiber line 38 may be deployed within conduit 44 by being pumped through conduit 44, before or after conduit 44 is deployed in wellbore 12. This technique is described in U.S. Reissue Pat. No. 37,283. Essentially, the fiber optic line 38 is dragged along the conduit 44 by the injection of a fluid at the surface. The fluid and induced injection pressure work to drag the fiber optic line 38 along the conduit 44. This pumping technique may be used in configurations where the conduit 44 and the fiber line 38 have a U-shape, as previously discussed, or in configurations where the conduit 44 and the fiber line 38 terminate in the wellbore. This fluid drag pumping technique may also be used to remove a fiber line 38 from a conduit 44 (such as if fiber line 38 fails) and then to replace it with a new, properly-functioning fiber line 38.

Figure 3:
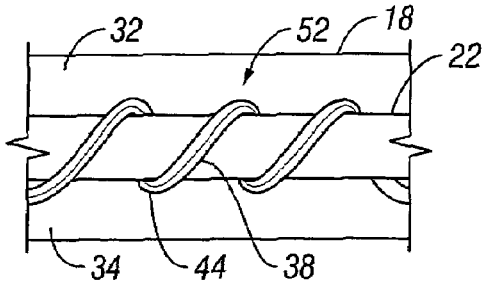
FIG. 3 is a schematic of another embodiment of the system, wherein the distributed temperature sensor is wrapped in a coil around a conveyance device.

FIG. 3 illustrates an embodiment of system 10 wherein a fiber line 38 (and relevant conduit 44) is arranged in a coil 52 around conveyance device 46 (production tubing 22) in the deviated section 18 of wellbore 12. Since conduit 44 in this embodiment wraps around the conveyance device 46, the use of coil 52 enables the determination of temperature profiles at different levels along the vertical axis 90 thereof, including the top and bottom areas 32, 34. Thus, coil 52 can also be used to determine the cross-sectional distribution of fluids along the vertical axis 90 of the deviated section 18, as previously disclosed. Coil 52 may also be used in the embodiment in which fiber optic line 38 and conduit 44 have a U-shape. Multiple coils 52 may also be placed along the deviated section 18 so as to provide the relevant measurement at more than one location of the deviated section 18.

Figure 4:
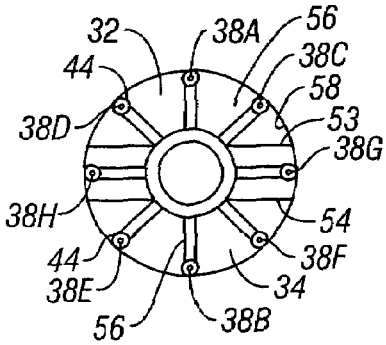
FIG. 4 is a schematic of another embodiment of the system, in which a plurality of fiber lines are disposed between the top area and the bottom area of the deviated section of a wellbore.

In another embodiment, a plurality of fiber lines 38 (and conduits 44) may be disposed around the circumference of conveyance device 46. FIG. 4 illustrates a system 10 having a fiber line 38A closer to the top of top area 32 and a fiber line 38B closer to the bottom of bottom area 34. In addition, this system 10 includes fiber lines 38C-H located at various levels between top fiber line 38A and bottom fiber line 38B. The use of these additional lines 38 provides temperature measurements at different levels between the top and bottom areas 32, 34, which allows the determination of the cross-sectional fluid distribution in the deviated section 18.

For instance, in FIG. 4, line 53 represents the hydrocarbon gas/hydrocarbon liquid interface, wherein the hydrocarbon liquid is located below the line 53 and the hydrocarbon gas is located above the line 53. Similarly, assuming water is present, line 54 represents the hydrocarbon liquid/water interface, wherein the hydrocarbon liquid is located above the line 54 and the water is located below the line 54. In this case, the fiber lines 38 located above line 53 (fiber lines 38A, C, D) and the fiber lines 38 located between line 53 and line 54 (fiber lines 38 G, H) will measure different temperatures. If water is present and it is at a temperature different than the hydrocarbon liquids, the fiber lines 38 located below line 54 (fiber lines B, E, F) will also measure different temperatures. An operator would thus be able to determine that hydrocarbon gas is present above line 53, hydrocarbon liquid is present between lines 53 and 54, and water is present below line 54. A change in the location of lines 53 or 54 will become known by a change in the temperature reading of the relevant fiber lines 38. It is noted that in the embodiment where water is not present only line 53 would be identifiable. It is also noted that use of the coil 52 of FIG. 3 also enables the determination of the interface locations since it includes measurements at different levels between the top and bottom areas 32, 34. The determination of the interfaces and the movement of the interfaces in time provides valuable information to an operator regarding the formation 20 and its production, as previously disclosed.

FIG. 4 also illustrates the use of extensions 56 attached to and extending from conveyance device 46. Conduits 44 and fiber lines 38 are disposed at the distal ends of extensions 56 so as to be proximate the wellbore wall 58. The use of extensions 56 enables the use of a larger range along the vertical axis 90 between the top area 32 and the bottom area 34. This in turn provides a more accurate measurement of the fluid as it flows from the formation 20 into the wellbore 12 and also provides a larger range for the determination of the interface locations. The use of extensions 56 also functions to centralize the conveyance device 46 within the wellbore 12.

FIG. 5 illustrates the use of a coiled tubing 50 as conveyance device 46. In this embodiment, conduit 44 (and fiber line 38) is located within coiled tubing 50 until it reaches bottom hole assembly 60, wherein the conduit 44 emerges from the interior of the coiled tubing 50. The conduit 44 is attached and located on the exterior of bottom hole assembly 60.

Figure 7:
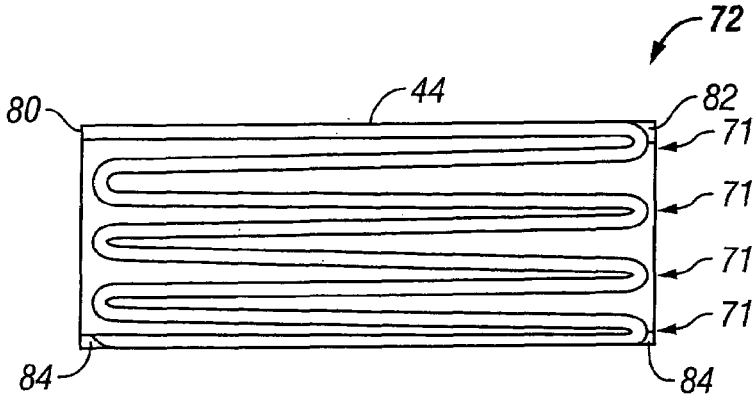
FIG. 7 is a schematic of a high resolution section of FIG. 6.

FIG. 6 illustrates another embodiment of the system 10. In this embodiment, the system 10 comprises at least one low resolution section 70 and at least one high resolution section 72. In each high resolution section 72, the fiber optic line 38 is configured so that it traverses the length of high resolution section 72 at least twice. One possible configuration of fiber optic line 38, as shown in FIG. 7, is for it to be looped 71 axially on the exterior of high resolution section 72 a number of times and in one embodiment around the circumference of the section 72. The object is for the fiber optic line 38 (corresponding to high resolution section 72) to be configured so that it can provide temperature profiles at different points along the vertical axis 90. Thus, a configuration, such as coil 52, is also an alternative. In a preferred embodiment, fiber optic line 38 exits high resolution section 72 so that it can pass through another high resolution section 72 or through a low resolution section 70.

In one embodiment, each low resolution section 70 includes a fiber optic line 38 proximate the top area 32 and a fiber optic line 38 proximate the bottom area 34 and is thus similar to the system described in relation to FIG. 1. In another embodiment (not shown), each low resolution section 70 includes only one fiber optic line 38; thus, in this embodiment, an operator would not be concerned with measuring the temperature profile along different levels of the vertical axis of the low resolution section 70.

Multiple high resolution sections 72 can be located along the length of a tubing 22 and stinger assembly 76. High resolution sections 72 may be interspersed among low resolution sections 70 and may be positioned so that they are located at particular locations along the deviated section 18 (such as across formations or along bends) once the tubing 22 and stinger assembly 76 is deployed within the wellbore 12. In the embodiment in which fiber optic line 38 is u-shaped, the bottom of stinger assembly 76 also includes a turn-around sub 78 (as in FIG. 1) to provide the overall U-shape to the fiber optic line 38 and relevant conduit 44.

In one embodiment, high resolution sections 72 and low resolution sections 70 are modular so that any section 70, 72 can be attached to any other section 70, 72 thereby allowing the greatest flexibility in deployment. In one embodiment, each high resolution section 72 includes a conduit 44 to house fiber optic line 38 (as previously disclosed) as well as a return line conduit 84. The conduit 44 within high resolution section 72 (and therefore the fiber optic line 38) is configured as previously described, and includes one entry 80 and one exit 82 (at either end of the section 72). In one embodiment, each low resolution section 70 includes two conduits 44, one housing the fiber optic line 38 extending away from surface 14 and the other housing the fiber optic line 38 extending to the surface 14.

In another embodiment, neither the high resolution section 72 nor the low resolution section 70 include a return line conduit 84 so that only one fiber optic line 38 is used.

In the case when two low resolution sections 70 are attached to each other, each of the conduits 44 of one section 70 is attached to its counterpart in the corresponding section 70. In the case when two high resolution sections 72 are attached to each other, the exit 82 of one section 72 is attached to the entry 80 of the other section 72, and the return line conduits 84 of the two sections 72 are attached to each other. In the case when a low resolution section 70 is attached to a high resolution section 72, one conduit 44 of the low resolution section 70 is attached to either the entry 80 or exit 82 (as the case may be) of the conduit 44 of the high resolution section 72 and the other conduit 44 of the low resolution section 70 is attached to the return line conduit 84 of the high resolution conduit 72.

As previously described, in order to determine the hydrocarbon gas, hydrocarbon liquid, and water flow rates in the deviated section 18 of a wellbore, one must first determine [a] the cross-sectional distribution of the different fluids and [b] the velocity of each of the fluids. When the flow regime is slug flow as previously described, instead of determining the velocity of each of the fluids, one can use the average of the fluid velocity in the core of the slug flow. As discussed, this invention provides a technique to determine the cross-sectional distribution of the different fluid.

Several techniques may be used to determine the velocity of each of the fluids in a deviated section 18 of a wellbore. For instance, flow sensors, as known in the art, may be deployed to provide the velocity of each of the fluids. In another embodiment, if the flow regime is slug flow, the fiber optic lines 38 and their derived temperature profiles may be used to track the gas and liquid slugs as they move along the wellbore. Thus, in this embodiment, the fiber optic lines 38 would also enable the calculation of the average of the fluid velocity in the core of the slug flow. In another embodiment, the fiber optic lines 38 may be used to track naturally occurring thermal events/spots (either cool spots or hot spots) as they occur and travel along the wellbore thereby enabling the calculation of the velocity of the fluid in which such thermal spots travel. In yet another embodiment, thermal events may be artificially introduced into the wellbore (such as by injecting nitrogen gas or steam), which thermal events are then tracked as they travel along the wellbore.

Thus, by knowing the cross-sectional distribution of the different fluid and the fluid velocity of each of the fluids, the flow rates of each of the fluids can be determined by an operator.

Figure 8:
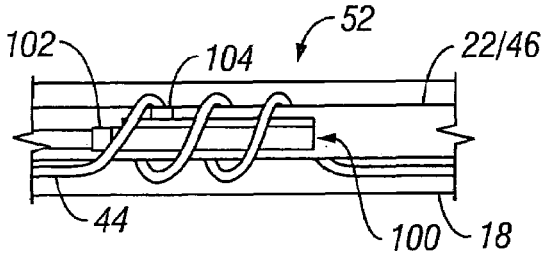
FIG. 8 is a schematic of a heating tool being deployed within a conveyance device with the distributed temperature sensor wrapped in a coil around the conveyance device.

In another embodiment, instead of using orienting device 62 as shown in FIG. 1, a different orienting method may be used to ensure that the operator knows the orientation of each fiber line 38 or each section of the fiber lines 38. In this embodiment as shown in FIG. 8, a heating tool 100 including an orienter 102 (such as a gyro) and at least one heating element 104 may be introduced into the conveyance device 46. The heating tool 100 is configured so that the orienter 102 orients the heating element 104 to be on a specific position/orientation within the conveyance device 46. For instance, the heating tool 100 may be configured so that the orienter 102 orients the heating element 104 to be on the top-most or bottom-most position/orientation within the conveyance device 46. Once properly oriented, the heating element 104 is activated allowing the operator to identify which fiber optic line 38 or which sections of the fiber optic line 38 (specially in the case of coil 52 or high resolution section 72) are adjacent the heating element 104 and are thus in the same or approximately the same orientation/position as the heating element 104. The heating tool 100 orienting method is shown in FIG. 8 used with coil 52, however, it may also be used with the embodiments including low and high resolution sections 70, 72 and multiple conduits 44 at different positions along the vertical axis 90 or deviated wellbore 18.

Figure 9:
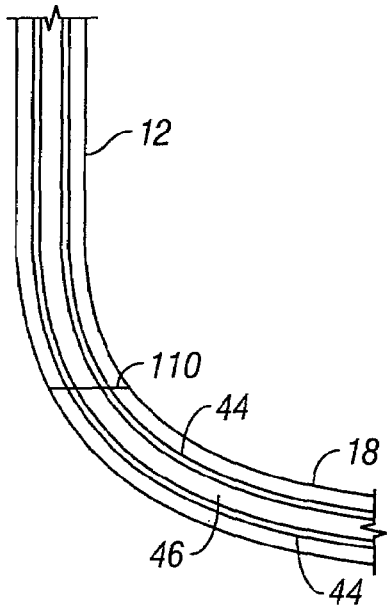
FIG. 9 is a schematic of a deviated wellbore with a hold up.
Figure 10:
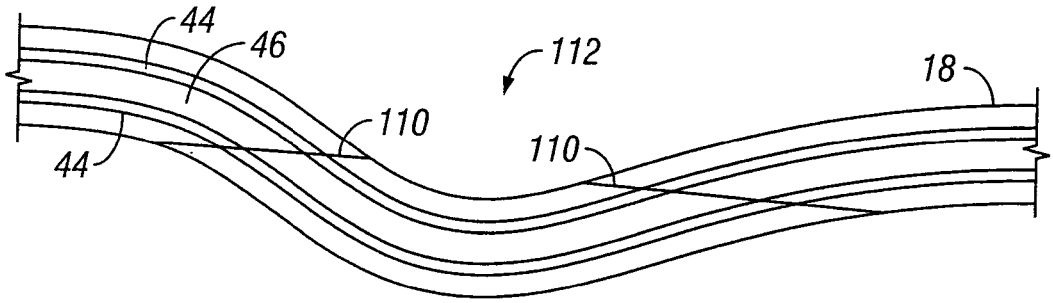
FIG. 10 is a schematic of a deviated wellbore including an undulation with a hold up.

System 10 may also be used to identify the location and extent of "hold up" in a deviated well 18. FIGS. 9 and 10 show different types of hold up. FIG. 9 shows a typical wellbore 12 with a deviated section 18 wherein fluid having a higher density is "held up" within the deviated section 18 at line 110 and an operator is attempting to produce fluid having a lower density. The higher density "hold up" prevents or inhibits the production of the lower density fluid because the lower density fluid struggles to flow through and past the higher density "hold up." Similarly, FIG. 10 shows a deviated section 18 including an undulation 112. Hold up, such as shown at line 110, can occur across the undulation 112, preventing or inhibiting the flow of lower density fluid through or past the held up higher density fluid. By use of the techniques previously disclosed, the system 10 within such a wellbore enables the determination of the location and extent of the hold up and line 110. In either case, the "held up" higher density fluid may be water and the lower density fluid may be liquid hydrocarbons or gas. Or, the "held up" higher density fluid may be liquid hydrocarbons and the lower density fluid may be gas. In one embodiment, only one fiber line 38 and conduit 44 is necessary to determine the location and extent of hold up.

Figure 11:
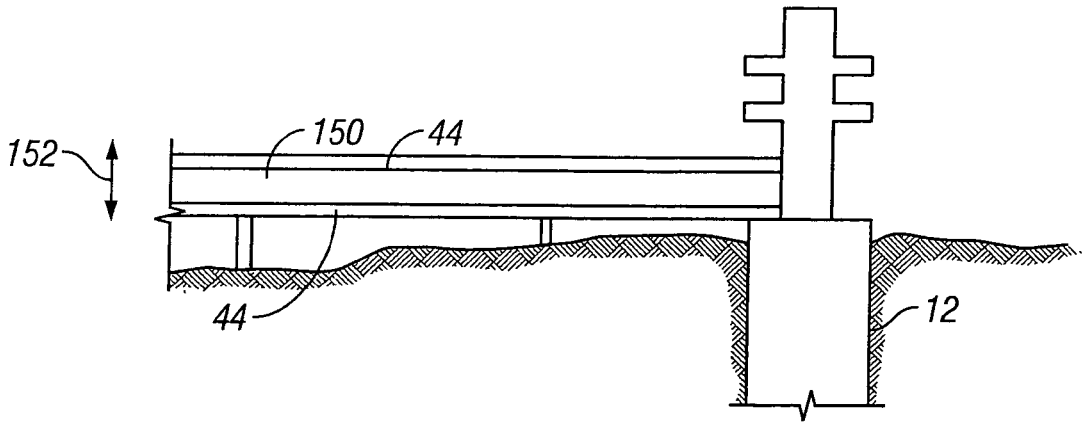
FIG. 11 is a schematic of a subsea pipeline including the system.

System 10 may also be used in conjunction with pipelines, particularly those that extend in a non-vertical direction (such as but not limited to the horizontal direction). Although it can be used with any pipeline, system 10 is shown in FIG. 11 being used in conjunction with a subsea pipeline 150. Subsea pipeline 150 carries the fluids produced from wellbore 12. Each embodiment previously described in relation to wellbore 12 (including the coil 52, high resolution section 72, sing or double conduit 44, multiple fiber optic line 38A-H, and hold up measurement) may be used with subsea pipeline 150 in order to identify the temperature profile at different levels along the vertical axis 152 of the subsea pipeline 150. For use with pipelines, the relevant fiber lines 38 and/or conduits 44 may be placed inside or outside the relevant pipeline 150 or they may be built into the pipeline cladding or structure. As previously described, the temperature profiles enable the determination of the cross-sectional distribution of the different fluids flowing in the pipeline 150 and the fluid velocity of each of the fluids. With this information, the flow rates of each of the fluids can be determined by an operator.

The inclusion of a distributed temperature sensor 36 such as the described fiber optic line 38 will also enable an operator to determine changes in state of the wellbore. For instance, the distributed temperature sensor 36 may be used to measure and locate the inflow of fluids into the wellbore, if the inflow fluids are at a temperature different than the fluids already in the wellbore. Thus, an operator may be able to tell at what points fluids are flowing into the wellbore. The distributed temperature sensor 36 may also be used to determine the existence of any flow behind the casing by measuring temperature differences caused by this flow. The distributed temperature sensor 36 may also be used to identify the presence and location of leaks from the tubing or casing also based on measured temperature difference.

The system 10 may also be used to identify the location around the circumference of the wellbore of any thermal event, such as inflows, leaks, or temperature differences of the fluids flowing in the wellbore. Once the azimuthal location of each distributed temperature sensor 36 is known (such as by the gyro or heating element methods described above), an operator will be able to determine the azimuthal location within the wellbore of any thermal event by determining which distributed temperature sensor 36 is closest and is most reactive to the thermal event. The azimuthal temperature measurement also helps to determine the stratification of fluids, as previously discussed, all the way to the surface through any deviated or vertical sections. With the OTDR measurement which enables the location of the depth of the thermal event, a total picture of the thermal events within a wellbore may be obtained by an operator. This information would be useful to an operator in order to visualize the fluids as they progress up the wellbore. These measurement can be performed using one or more distributed temperature sensors 36 (fiber optic lines 38) as per the embodiments previously disclosed.

While the invention has been disclosed with respect to a limited number of embodiments, those skilled in the art, having the benefit of this disclosure, will appreciate numerous modifications and variations therefrom. For instance, the conduits 44 and fiber lines 38 may be located in the interior of the conveyance device 46 (such as tubing 22, coiled tubing 50, and stinger assembly 76). Moreover, the conduits 44 and fiber lines 38 may pass to and from the interior and exterior of conveyance devices 46 by use of cross-over tools at specific locations, such as proximate bottom hole packer 79. In addition, although the drawings have shown the use of a system 10 in a substantially horizontal well, it is understood the system 10 can be used in a deviated section, as that term is defined herein, or even in a vertical well. It is intended that the appended claims cover all such modifications and variations as fall within the true spirit and scope of the invention.

What is claimed is:

1. A method for determining the cross-sectional distribution of fluids along a pipeline, comprising:

measuring a temperature profile along at least two levels of a vertical axis of a pipeline using at least one fiber optic line; and comparing the temperature profiles to determine whether different fluids are present in each of the levels; and communicating the result of the comparison.

2. The method of claim 1, wherein the measuring step comprises measuring a temperature profile proximate a top area of the pipeline using a first fiber optic line and measuring a temperature profile proximate a bottom area of the pipeline using a second fiber optic line.

3. The method of claim 2, further comprising measuring at least one temperature profile intermediate the top area and the bottom area by using at least one additional fiber optic line and wherein the comparing step comprises comparing each of the temperature profiles to determine whether different fluids are present along a vertical axis of the pipeline.

4. The method of claim 1, further comprising coiling at least a portion of the at least one fiber optic line within the pipeline.

5. The method of claim 1, further comprising providing at least one conduit to house the at least one fiber optic line.

6. The method of claim 1, further comprising placing the pipeline in a subsea environment.

7. A system for determining the cross-sectional distribution of fluids along a pipeline, comprising at least one fiber optic line adapted to measure a temperature profile along at least two levels of a vertical axis of a pipeline; and a heating element adapted to be deployed into the pipeline wherein the activation of the heating element enables the identification of the orientation of the at least one fiber optic line.

8. The system of claim 7, comprising:

a first fiber optic line proximate a top area of the pipeline adapted to measure a temperature profile; and a second fiber optic line proximate a bottom area of the pipeline adapted to measure a temperature profile.

9. The system of claim 8, further comprising at least one additional fiber optic line intermediate the top area and the bottom area and adapted to measure a temperature profile.

10. The system of claim 7, wherein at least a portion of the at least one fiber optic line is coiled within the pipeline.

11. The system of claim 7, further comprising at least one conduit housing the least one fiber optic line.

12. The system of claim 7, wherein the at least one fiber optic line is axially looped at least twice along a length of the pipeline.

13. The system of claim 7, wherein the pipeline comprises a subsea pipeline.

* * * * *